United States Patent [19]

Jacobsson

[11] 3,949,573

[45] Apr. 13, 1976

[54] THREAD DELIVERY DEVICE FOR TEXTILE MACHINES

[75] Inventor: Kurt Arne Gunnar Jacobsson, Ulricehamn, Sweden

[73] Assignee: Aktiebolaget IRO, Ulricehamn, Sweden

[22] Filed: Mar. 10, 1975

[21] Appl. No.: 557,118

[30] Foreign Application Priority Data

Mar. 12, 1974 Germany ..... 2411876

[52] U.S. Cl. ..... 66/132 T; 74/221; 226/74; 226/172

[51] Int. Cl.[2] ..... D04B 15/48

[58] Field of Search ..... 74/221; 242/47.01; 66/132 T, 125 R; 226/74, 75, 172

[56] References Cited

UNITED STATES PATENTS

| | | | |
|---|---|---|---|
| 2,845,166 | 7/1958 | Schaeffer | 74/221 UX |
| 3,243,091 | 3/1969 | Rosen | 66/132 T |
| 3,363,815 | 1/1968 | Vostal | 66/132 T X |
| 3,675,446 | 7/1972 | Cooke | 66/132 T |
| 3,810,569 | 5/1974 | Fulk | 226/74 X |

FOREIGN PATENTS OR APPLICATIONS

| | | | |
|---|---|---|---|
| 858,501 | 1/1961 | United Kingdom | 226/74 |

OTHER PUBLICATIONS

Eichorn, *Feeding Apparatus for Continuous and Cut Forms*, IBM Tech. Disc. Bul., Vol. No. 8, Published Jan. 1974.

*Primary Examiner*—Mervin Stein
*Assistant Examiner*—Andrew M. Falik
*Attorney, Agent, or Firm*—Woodhams, Blanchard and Flynn

[57] ABSTRACT

A thread delivery device for a textile machine in which a member associated with a thread delivery arrangement is driven by a driving belt which in turn is driven by a driving wheel whose effective diameter can be varied to vary the speed of the driving belt. The driving belt is engaged with a running surface associated with the driving wheel. The driving belt is provided with holes therein, and the running surface of the driving wheel is formed by a second driving belt with pins on its outer face which engage in the holes of the first-mentioned driving belt to provide a slip-free connection therebetween. The second driving belt is engaged with and extends between the driving wheel and a further guide or idler wheel.

8 Claims, 3 Drawing Figures

THREAD DELIVERY DEVICE FOR TEXTILE MACHINES

FIELD OF THE INVENTION

The invention relates to a thread delivery device for textile machines, particularly knitting machines, in which a member cooperating with the thread delivery means is driven via a driving belt which is in turn driven by a driving wheel whose effective diameter can be varied to adjust the speed of the driving belt.

BACKGROUND OF THE INVENTION

There is a known arrangement in which a plurality of thread delivery devices, each delivering one thread, are distributed along the circumference of a support ring above a conventional circular knitting machine. Each thread delivery device in this case comprises a roller or pulley, all of which are driven by a common driving belt which in turn is driven by a driving wheel. With these known thread delivery devices, the thread to be drawn off each bobbin is passed between the driving belt and pulley at the point of contact thereof so that it is conveyed by the pulley or belt and can then be fed to a textile machine in the conventional manner. The running speed of the driving belt must be varied to enable the feeding speed of the thread delivery devices to be varied. In the case of the known arrangement this is done by altering the effective diameter of the driving wheel, the driving belt in each case being simultaneously maintained in a clamped position by a clamping device even when the driving wheel diameters are different. The diameter of the driving wheel can be varied with the aid of a plurality of separating members which are arranged between two pulleys and, together with the outer circumference thereof, form the running surface of the driving belt. The various separating members are radially slidable relative to the axle of the driving wheel so that the diameter of the running surface can be infinitely varied over a relatively wide area.

Since unavoidable slipping occurs both between the driving wheel and driving belt and between the pulleys associated with each thread delivery device, particularly when a great number of thread delivery devices are simultaneously driven by a single driving belt, such slipping altering the desired thread delivery speed in each respective case, the running surfaces of both the driving wheel and the various pulleys were provided with pins which engage in holes in the driving belt. This positive connection between the running surfaces of the driving wheel and pulleys, on the one hand, and the driving belt, on the other hand, reliably prevents slipping even when a very large number of thread delivery devices are driven by a single driving belt. With these thread delivery devices it is also customary for the thread awaiting delivery to be guided not directly between the pulley and driving belt, but via a thread drum mounted on the same axle as the pulley, in which case either the thread to be delivered is wound only once around the thread drum or alternatively the drum can also store a predetermined thread supply simultaneously when the thread is wound around it several times and appropriately drawn off.

If a positive connection in the form of pins and holes is provided between the driving belt and driving wheel to prevent slippage, the variation of driving wheel diameter provided for varying the rate of delivery in the known arrangement cannot be used since, in the event of radial displacement of the separating members forming the running surface, the mutual spacing between pins provided on the circumference of these separating members would naturally also be altered.

The problem for the invention is to provide a new thread delivery device in which, despite a positive connection provided between the driving belt and driving wheel with the aid of pins and holes, the driving belt speed can nevertheless be simply varied by varying the effective diameter of the driving wheel.

The problem is solved in accordance with the invention with a thread delivery device of the said type in that, for the use of a driving belt provided in a manner known per se with holes in which pins engage to produce a slip-free connection with a running surface cooperating with the driving belt, the running surface of the driving wheel is formed by a second driving belt with pins on its outer side which, while the belt rotates between the driving wheel and a guide or idler pulley, engage in the holes in the first driving belt.

Owing to the arrangement, surprisingly simple in appearance, of a second driving belt on the variable effective diameter of the driving wheel, the mutual spacing between the pins on the outer surface of this second belt can be kept constant irrespective of the size of the effective diameter. In this connection the second driving belt is maintained under constant tension with the aid of a guide pulley irrespective of the diameter of the driving wheel. The thread delivery device according to the invention therefore combines the advantages of simple adjustment of the driving belt speed through continuous variation of the effective diameter of the driving wheel and of a slip-free positive connection between the driving belt and at least the driving wheel by means of holes and pins. In addition to the running surface of the driving wheel, the surfaces of some or all of the pulleys in the thread delivery devices could obviously be provided with pins.

In accordance with a preferred embodiment of the invention the driving wheel comprises two cone-shaped pulleys arranged on a common axle and driving the driving belt between them, the distance between these pulleys being variable to vary the effective diameter of the driving wheel. This possibility of varying the effective diameter of a driving wheel or pulley, which is basically known in belt drives, represents a solution which is very simple in construction and particularly reliable in operation for varying the effective diameter of the driving wheel.

In accordance with a first embodiment of the invention the guide pulley is an idler pulley of constant diameter, whose bearing is preloaded in the direction away from the driving wheel. With the aid of this guide pulley the driving belt is maintained under constant tension irrespective of the diameter of the driving wheel since the bearing of the pulley endeavours to maintain the maximum spacing from the axis of rotation of the driving wheel e.g. with the aid of springs.

In accordance with a second embodiment of the invention the guiding pulley is an idler pulley comprising two cone-shaped or tapered wheels which are mounted on a common axle and the distance between which can be increased in opposition to the force of a spring in order to reduce the effective diameter of the idler pulley. In this case the pulley is therefore mounted in a similar manner to the driving wheel, the spring acting on one of the cone-shaped wheels causing the effective diameter of the idler pulley to be constantly varied in the opposite direction to the effective diameter of the driving wheel.

One of the cone-shaped pulleys of the driving wheel is axially rigidly secured on the axle while the other cone-shaped pulley can be fixed at a predetermined distance from the first cone-shaped pulley with the aid of a screw thread provided on the axle and an adjusting nut associated with the pulley. Through appropriate adjustment of the adjusting nut, a predetermined diameter of the driving wheel and therefore the desired driving belt speed in each case can be infinitely preselected.

In accordance with an embodiment of the invention the second driving belt is designed and/or made of such material that substantially no slipping occurs between the belt and driving wheel.

BRIEF DESCRIPTION OF THE DRAWINGS

The invention will be explained in more detail with the aid of practical embodiments illustrated in the drawings. In each of the drawings.

DETAILED DESCRIPTION

Figure 1:
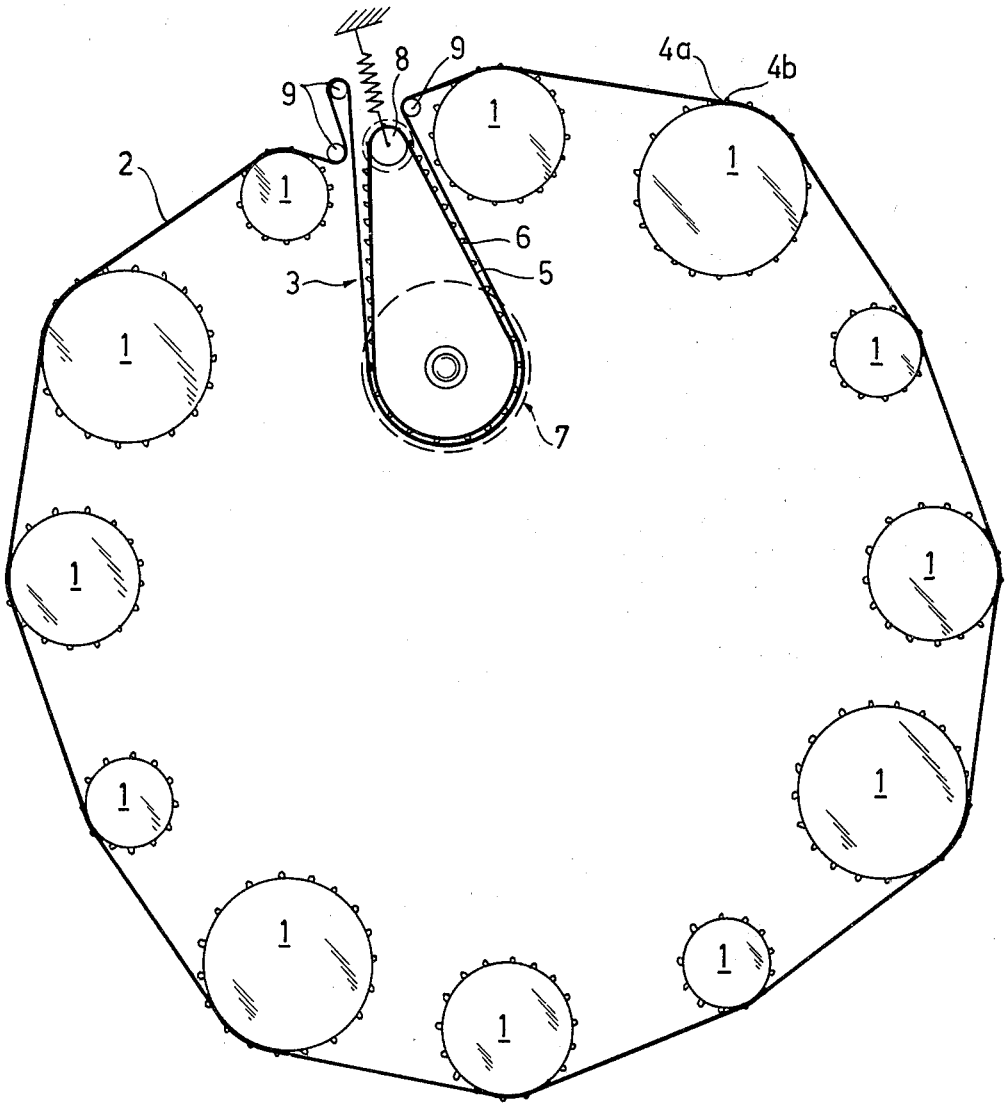
FIG. 1 is a diagrammatic view showing an arrangement comprising a plurality of thread delivery devices as normally associated with a circular knitting machine.

In the arrangement shown in FIG. 1 there are provided a plurality of belt pulleys 1 forming a number of thread delivery devices along the circumference of a ring support (not shown) above a conventional circular knitting machine (also not shown). A driving belt 2 common to all the pulleys 1 also runs along the circumference of the ring support and engages each of the pulleys. A driving system 3 for this belt 2 comprises a second driving belt 5 which is driven by a driving wheel 7 and guided and maintained under tension by a spring-urged idler pulley 8. As shown in the diagrammatic view in FIG. 1, the idler pulley 8 can be drawn in the direction away from the driving wheel 7 e.g. with the aid of a spring so that the second driving belt 5 is maintained under substantially constant tension. Each of the pulleys 1 for the various thread delivery devices comprises on its running surface pins 4*a* which engage in holes 4*b* in the driving belt 2, thus producing a positive connection between the driving belt 2 and pulleys 1. On the other hand, the outer face of the second driving belt 5 is provided with pins 6 which have the same mutual spacing as the pins 4*a* on the running surfaces of the belt pulleys 1. Since for driving purposes the driving belt 2 runs around the driving wheel 7 and therefore also around the belt 5 guided via the driving wheel 7 the pins 6 of the second driving belt 5 also engage in the holes 4*b* in the belt 2 thereby also producing a positive connection between the second driving belt 5 and the first driving belt 2. If the effective diameter of the driving wheel 7 is altered to vary the speed of the driving belt 2, the length of that part of the second driving belt 5 running around the driving wheel 7 is therefore altered simultaneously, but not the mutual spacing between the pins 6 on the second driving belt 5. When the diameter of the driving wheel 7 is changed the second driving belt 5 is maintained under tension by appropriate adjustment of the idler pulley 8. However, the driving belt 2 is also maintained under tension with the aid of idler and deflecting pulleys 9 irrespective of the diameter of the driving wheel 7 in each case.

Figure 2:
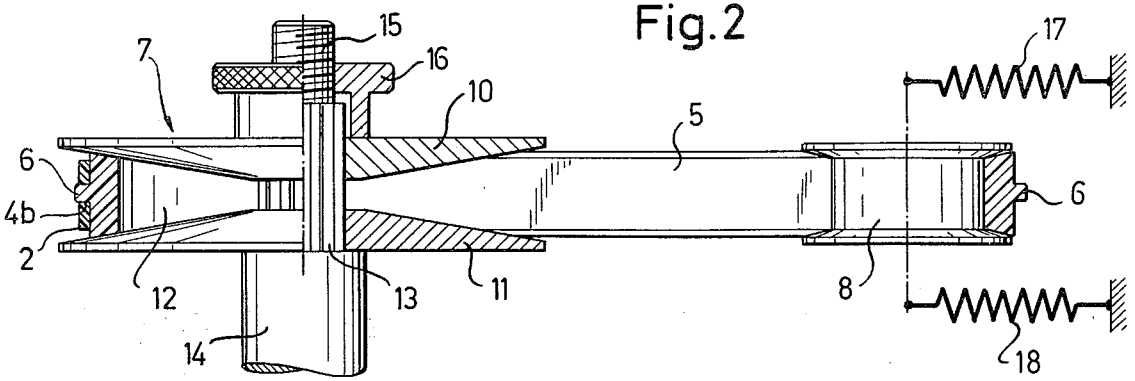
FIG. 2 shows a first embodiment of the driving wheel with the second driving belt.

A first embodiment of the driving arrangement 3 is illustrated in FIG. 2. The driving wheel 7 comprises two cone-shaped or tapered pulleys 10 and 11 mounted on a common axle 14, the axial distance between said pulleys being variable. The pulleys 10 and 11 are nonrotatably mounted on the axle 14 with the aid of a conventional key joint 13. On a stub 15 of the axle 14 there is provided a thread on which an adjusting nut 16 is to be adjusted. The maximum axial spacing between the two pulleys 10 and 11 is determined by adjustment of the adjusting nut 16 in each case. Running between the pulleys 10 and 11 is the second driving belt 5 with pins 6 on its outer face. The pins 6 engage in the holes 4*b* in the first driving belt 2. The other end of the track 12 on the second belt 5 is guided via the idler pulley 8 whose bearing is preloaded in the direction away from the driving wheel 7 with the aid of springs 17 and 18, in a manner only shown diagrammatically here, in order to maintain the tension of the driving belt 5 irrespective of the diameter of the driving wheel 7. As can be seen from FIG. 2, the second driving belt 5 is very much thicker in design than the first belt 2 so that slippage between the second driving belt and driving wheel 7 is at a minimum, i.e. negligible. This can obviously be further improved upon by using an appropriate material for the second driving belt.

Figure 3:
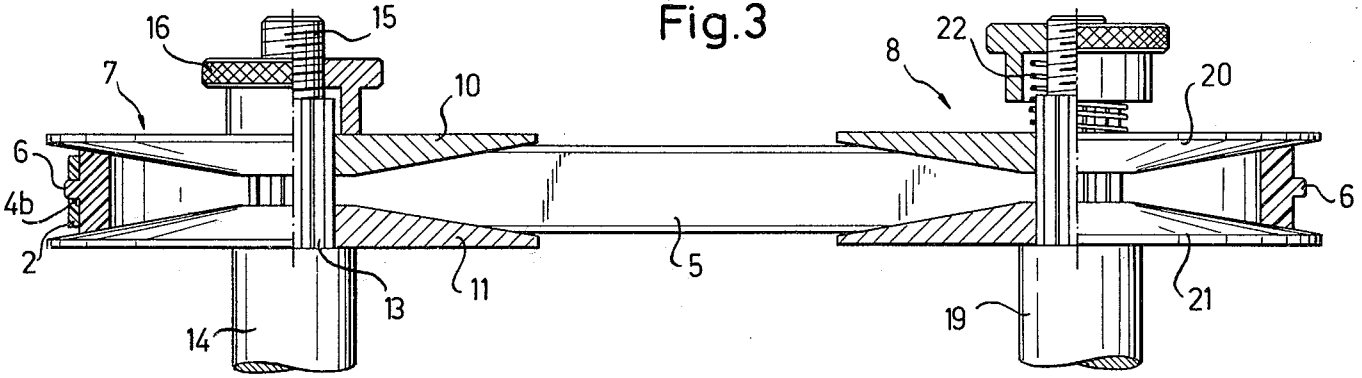
FIG. 3 shows a second embodiment of the driving wheel with the second driving belt.

FIG. 3 shows a slightly different embodiment of the driving arrangement 3, although the driving wheel 7 is identical in design to that shown in FIG. 2. In contrast to the embodiment in FIG. 2, however, the idler pulley 8 is designed similar to the driving wheel 7. Two cone-shaped pulleys 20 and 21 are nonrotatably mounted on an axle 19, and in this connection the pulley 20 can be moved axially away from the pulley 21 in opposition to the force of a return spring 22, i.e. it can increase the distance between it and the pulley 21. When the spacing is increased, the effective diameter of the idler pulley 8 is reduced at the same time. If therefore the effective diameter of the driving wheel 7, for example, is increased by reducing the mutual spacing between the pulleys 10 and 11, the effective diameter of the idler pulley 8 is simultaneously reduced to the same degree by increasing the mutual spacing between the pulleys 20 and 21. The idler pulley 8 used in the embodiment shown in FIG. 3 can therefore be rigidly mounted, that is, mounted a fixed distance from the driving pulley 7, thereby providing a simpler construction.

Although not shown in the arrangement of thread delivery devices which are only diagrammatically represented, the belt pulleys of each thread delivery device shown in FIG. 1 can positively feed the thread directly between the running surface of each pulley 1 and the driving belt 2 or alternatively via a special thread drum which is mounted preferably on the same axle as the pulleys 1 of each thread delivery device. In this case the thread delivery devices operating with a separate thread drum can either be designed so that they deliver the thread only in a positive manner when this thread is wound once around the thread drum or they can in addition store a predetermined thread supply on the drum when the thread is wound several times around the drum and appropriately drawn off. Furthermore, the thread delivery devices operating with a special thread drum can be designed so that they can always feed the thread to the textile machine in question in an intermittent or alternatively in a positive/intermittent manner.

Although the diameter of the driving wheel in the embodiment shown here is varied by varying the spacing between two cone-shaped pulleys, this can obviously be done also by other suitable embodiments, such as e.g. the separating members disclosed in German Auslegeschrift No. 1 286 680.

What we claim is:

1. In a thread delivery device for a textile machine, in which a member associated with a thread delivery arrangement is driven by a driving belt which in turn is driven by a driving wheel whose effective diameter can be varied to vary the speed of said driving belt, said driving belt being engaged with a running surface associated with said driving wheel, comprising the improvement wherein said driving belt is provided with holes therein, and wherein the running surface of the driving wheel is formed by a second driving belt with pins on its outer face which engage in the holes of said first-mentioned driving belt to provide a slip-free connection therebetween, the second driving belt being engaged with and extending between said driving wheel and a further wheel.

2. A thread delivery device according to claim 1, wherein the driving wheel comprises two opposed cone-shaped members mounted on a common axle and having the second driving belt engaged therebetween, the distance between the cone-shaped members being variable to vary the effective diameter of the driving wheel.

3. A thread delivery device according to claim 1, wherein said further wheel is an idler pulley of constant diameter whose bearing is biased in a direction away from the driving wheel.

4. A thread delivery device according to claim 1, wherein said further wheel is an idler pulley comprising two cone-shaped wheels which are mounted on a common axle and the distance between which can be increased in opposition to the force of a spring to reduce the effective diameter of the idler pulley.

5. A thread delivery device according to claim 2, wherein said further wheel is an idler pulley of constant diameter whose bearing is biased in a direction away from the driving wheel.

6. A thread delivery device according to claim 2, wherein said further wheel is an idler pulley comprising two cone-shaped wheels which are mounted on a common axle and the distance between which can be increased in opposition to the force of a spring to reduce the effective diameter of the idler pulley.

7. A thread delivery device according to claim 2, wherein one of the cone-shaped members is axially rigidly mounted on the axle while the other cone-shaped member can be secured at a predetermined distance from said one cone-shaped member with the aid of a threaded stub provided on the axle and an adjusting nut associated with the stub.

8. A thread delivery device according to claim 2, wherein the second driving belt is designed such that substantially no slippage occurs between the belt and the driving wheel.

* * * * *